US005486661A

United States Patent [19]

Jambor et al.

[11] Patent Number: 5,486,661

[45] Date of Patent: Jan. 23, 1996

[54] LIMIT SWITCH LEVER

[75] Inventors: George F. Jambor, New Berlin, Wis.; David W. Place, Hendersonville, N.C.

[73] Assignee: Eaton Corporation, Cleveland, Ohio

[21] Appl. No.: 274,086

[22] Filed: Jul. 12, 1994

[51] Int. Cl.[6] ..... H01H 3/16

[52] U.S. Cl. ..... 200/47; 200/329; 403/370

[58] Field of Search ..... 200/47, 329, 332, 200/335; 403/370, 368, 367, 374, 351, 356, 375; 74/63

[56] References Cited

U.S. PATENT DOCUMENTS

| | | | |
|---|---|---|---|
| 1,444,352 | 2/1923 | Mason | 287/52.08 |
| 3,041,888 | 7/1962 | Dehn | 74/559 |
| 3,255,641 | 6/1966 | Russell | 287/52.08 |
| 3,385,129 | 5/1968 | Duncan et al. | 74/545 |
| 3,463,523 | 8/1969 | Vasas | 287/189.36 |
| 3,745,289 | 7/1973 | Hipple | 200/172 A |
| 3,882,290 | 5/1975 | Duncan | 200/47 |

*Primary Examiner*—Henry J. Recla
*Assistant Examiner*—David J. Walczak
*Attorney, Agent, or Firm*—Larry G. Vande Zande

[57] ABSTRACT

A rectangular cavity is provided in an actuator lever intersecting with an upper edge of a shaft-receiving hole in the lever and receives a linearly slidable hard metal rectangular key having a cam on one edge for clamping the lever to the shaft. A screw engages threads on the key and is slidable with the key to a position where a distal end of the key is flush with or projects from a side surface of the lever, at which position the cam is free of the shaft-receiving opening, the key providing visual indication that the lever assembly may be positioned over the shaft without interference.

13 Claims, 1 Drawing Sheet

LIMIT SWITCH LEVER

BACKGROUND OF THE INVENTION

This invention relates to electrical limit switches of the type wherein an actuator lever is attached to a rotatable shaft journaled in a housing. Deflection of the distal end of the lever effects rotation of the shaft which in turn effects operation of a snap action switch within the housing. More particularly, this invention relates to improved means for mounting an actuator lever to a rotatable shaft of an electrical limit switch.

Limit switch actuator levers are usually die cast of a light weight material such as aluminum or the like. A hole is provided in the lever for disposition of the lever over a rotatable shaft of the limit switch. Various means have been provided heretofore for securely attaching the lever to the shaft such as providing a slotted end in the lever and providing a clamping member around that slotted end to clamp the lever to the shaft as shown in U.S. Pat. No. 3,385,129 to E. F. Duncan et al. Another means for attaching an actuator lever to a limit switch rotatable shaft provides a second hole in the lever at right angles to the hole for the shaft wherein the second hole partially intersects the first hole. A screw threaded pin placed in the second hole is provided with a recess in the shank portion thereof which aligns with the hole for the shaft and thereby affords clearance for the limit switch shaft. A nut is turned onto the threaded portion at an exterior surface of the lever to draw the shank of the pin toward the nut when tightened, thereby wedging an edge of the recessed surface against the rotatable shaft to clamp the lever to the shaft as shown in U.S. Pat. Nos. 3,255,641 issued to W. J. Russell and 3,041,888 issued to W. F. Dehn. Still another attachment means is shown in U.S. Pat. No. 3,045,289 issued to G. M. Hipple wherein a cylindrical peg having a flattened surface is inserted within a second opening intersecting the shaft opening of the lever. A transition from the flat surface to the cylindrical shape of the peg provides a wedge against the shaft when a set screw is tightened within a threaded outer end portion of the second opening of the lever. A spring pin is driven through a third hole in the lever to cooperatively engage the flattened surface of the peg to keep the peg properly aligned relative to the opening for the shaft.

The patent to Duncan et al addresses advantages realized by eliminating appendages extending from the mounting end of the lever which could interfere with machinery surfaces to restrict full movement of the lever, and by providing the screw threads in a hard metal member such as a steel bracket or the like. Hipple recognizes a problem with the cylindrical pin wedge such as used in the patents to Russell and Dehn. The cylindrical shape of the pin shank within the cylindrical second hole requires that the screw not only be linearly positioned within the second hole, but also be rotated to cause the recess in the pin to align with the hole for the shaft in order to assemble the lever to the shaft. Hipple provides a flattened end portion of a cylindrical peg and a spring pin driven into a third hole in the lever intersecting the second hole. The peg is rotated to align the flattened end portion with the spring pin and then fully inserted into the second hole whereby the flattened end portion cooperates with the spring pin to maintain the peg rotatably positioned within the lever. This construction has the disadvantage of requiring a third hole in the lever and a spring pin driven into the third hole, thereby requiring additional operations and parts for the assembly of the lever. Hippie also does not provide a hard metal such as steel for the threads engaged by the clamping screw.

SUMMARY OF THE INVENTION

This invention provides an improved clamping means for attaching an actuator lever to the rotatable shaft of an electrical limit switch. The improved attachment means comprises a straight-sided cavity in the lever partially intersecting a hole in the lever which receives the rotatable shaft, a rectangular shaped key slidably mounted in the cavity and having a cam on one edge which is positioned to project into the hole for the shaft at the intersection of the cavity and the hole when the key is driven linearly by a screw which projects through an opening in the lever to engage with threaded portions of the key within the cavity. The cavity and the key preferably have complemental rectangular cross sections to prevent rotation of the key. A semi-cylindrical groove along one edge of the key is threaded to receive the shank of the screw while the complemental surface of the cavity is also provided with a semi-cylindrical groove to provide a complemental opening for the screw shank. The key may be formed of a hard metal to provide strength to the threads. The length of the key between a distal end and the cam surface is selected such that the cam surface is free of the hole for the shaft when the distal end of the key is flush with the exterior side surface of the lever. The key and the screw are slidable as a unit with respect to the lever and therefore proper alignment of the cam surface free of the shaft-receiving hole is readily determined when assembling the lever to the shaft by pressing the screw head against one external side surface of the shaft and observing that the end of the key is at least flush or protruding from the other external side surface of the lever. These and other features and advantages of the invention will become more readily apparent when reading the following description and claims in conjunction with the accompanying drawings.

DETAILED DESCRIPTION OF THE PREFERRED EMBODIMENT

Figure 1:
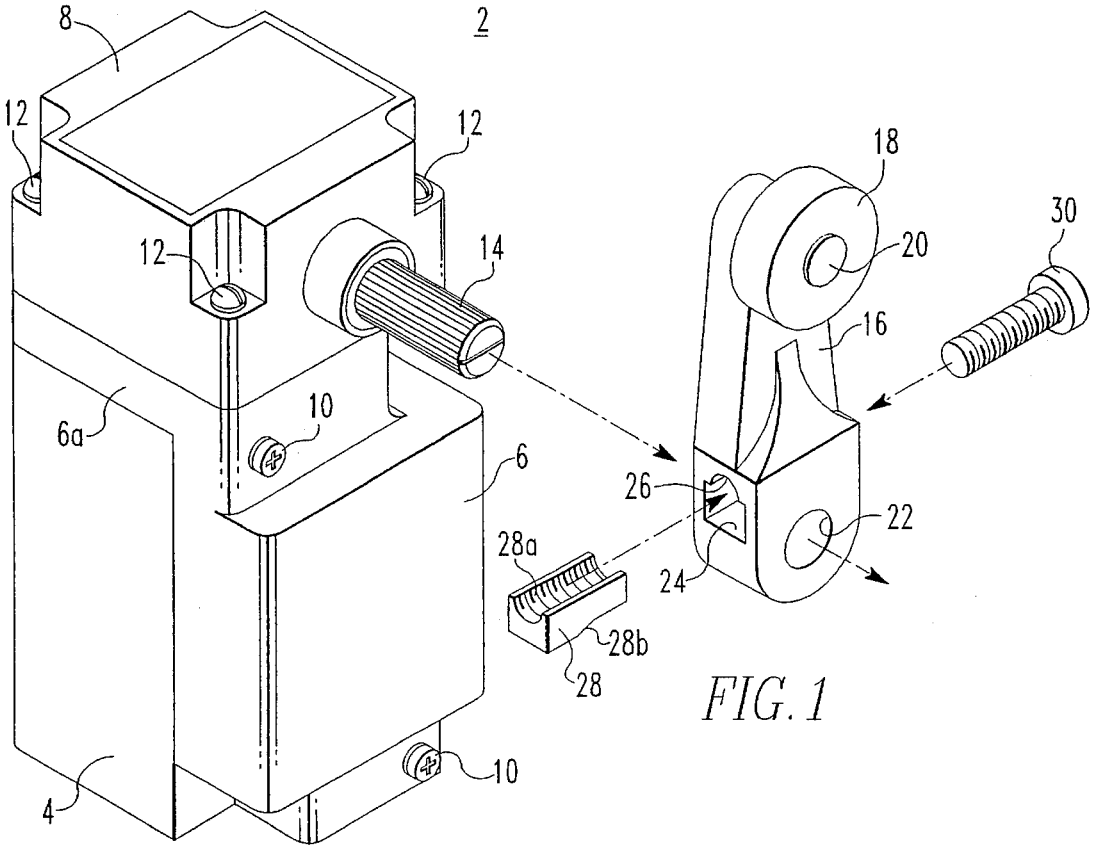
FIG. 1 is an exploded isometric view of a limit switch, actuator lever and attachment means constructed according to this invention.
Figure 3:
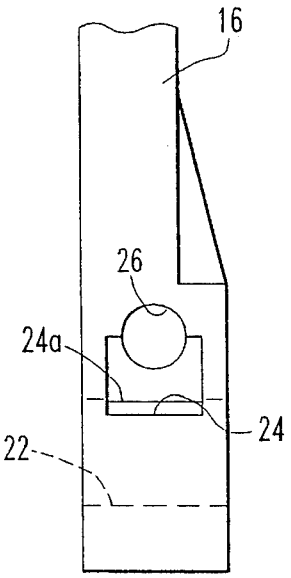
FIG. 3 is a left-hand elevational view of the lower portion of the actuator lever of FIG. 2.

Referring to FIG. 1 of the drawings, there is shown a limit switch 2 generally of the type described and shown in U.S. Pat. No. 3,882,290 issued May 6, 1975 to E. F. Duncan and assigned to the assignee of this application by mesne assignments. The disclosure of U.S. Pat. No. 3,882,290 is incorporated herein by reference. Limit switch 2 is of modular construction incorporating a base receptacle 4, a switch 6 and an operating head 8. Base receptacle 4 is mounted directly to the apparatus on which the limit switch is used and, while not shown, comprises a plurality of internal terminals having wire receiving screws for hard-wired connection with wires from an incoming supply and wires to the apparatus controlled by the limit switch. The terminals also have plug-in portions which cooperatively engage with plug-in switch contact terminals of the switch module 6 when the latter is mounted to the receptacle 4. The operating head 8 has a rotatable operating shaft 14 extending from one side thereof and is positioned upon a platform 6*a* of the switch module 6 with the shaft 14 in one of four orientations. The operating head 8 has an internal motion translating mechanism that translates rotational movement of shaft 14 to linear movement into switch module 6 to operate switch contacts within the switch module. Switch module 6 is secured to base receptacle 4 by a pair of screws 10. Operating head 8 is secured to the switch module platform 6*a* by four screws 12, only three of which are visible in FIG. 1.

Figure 2:
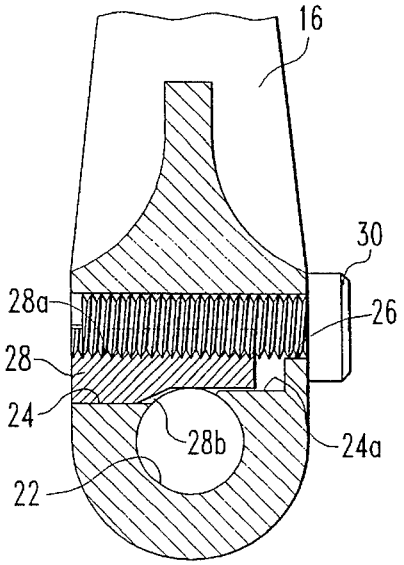
FIG. 2 is a cross sectional view of the lower portion of the actuator lever and the attachment means of this invention.
Figure 4:
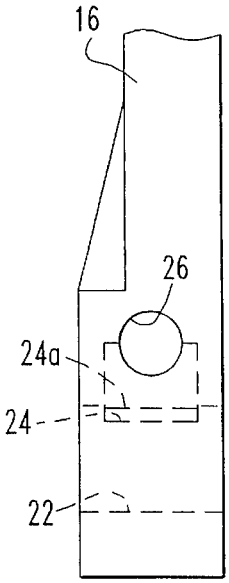
FIG. 4 is a right-hand elevational view of the lower portion of the actuator lever of FIG. 2.

An actuating lever 16 is attached to shaft 14 to actuate the limit switch 2. Actuating lever 16 is one of several types of levers used on limit switches. The lever 16 has a roller 18 rotatably journaled to one end of the lever by a rivet 20. The opposite end of lever 16 is provided with a hole 22 extending through the lever for receiving the shaft 14 of limit switch 2. Lever 16 has a rectangular cavity 24 extending inwardly from the left exterior side surface of the lever as viewed in the drawings. The cavity 24 partially intersects the hole 22 along an upper portion of the hole 22. As best seen in FIG. 2, the interior end of rectangular cavity 24 is stepped upward essentially tangential with the hole 22. A round opening 26 is formed in lever 16 at the right-hand exterior side surface as viewed in the drawings, the opening 26 extending into rectangular cavity 24. The center axis of round opening 26 is disposed essentially along the upper surface of rectangular cavity 24, and the upper semi-cylindrical portion of the opening 26 extends entirely through the lever 16 to the left-hand exterior side surface as viewed in the drawings.

A rectangular key 28 shaped complementally to the rectangular cavity 24 and dimensionally toleranced to permit linear sliding motion of the key 28 within the cavity 24 is inserted into the cavity from the left-hand exterior side surface. The key 28 has a semi-cylindrical groove 28*a* formed along its upper surface, which groove is complementally arranged with the semi-cylindrical portion of opening 26 to form a complete cylindrical opening for the threaded shank of a screw 30 insertable from the right-hand exterior side surface of lever 16 through the opening 26. Groove 28*a* is provided with helical screw threads to complementally engage the threaded shank of screw 30. Key 28 is preferably made of a hard metal such as stainless steel or the like to provide good strength for the thread segments in groove 28*a*. The semi-cylindrical surface of opening 26 is not threaded, but is smooth so as to permit sliding motion of the screw 30 axially relative to the lever. An angular cam surface 28*b* is provided on the underside of key 28, the cam surface extending into the opening 22 for shaft 14 when key 28 is drawn inwardly of lever 16 by rotation of screw 30. The angular cam surface 28*b* wedges against the shaft 14 of limit switch 2 to securely clamp the actuator lever 16 to the shaft 14.

It may be seen in FIG. 2 that the angular cam surface 28*b* is disposed to the left of the hole 22 when the left-hand or distal end of key 28 is flush with the left exterior side surface of lever 16. Thus, cam surface 28*b* is moved free of interfering with assembly of lever 16 onto shaft 14 any time the distal end of the rectangular key 28 is flush or projects from the left-hand exterior side surface of lever 16. The rectangular shape of key 28 and cavity 24 prevent rotational misalignment of the cam portion 28*b* or the key 28 itself relative to the hole 22 which would tend to interfere with positioning lever 16 over shaft 14. Thus, by causing the threads of screw 30 to engage the threads of key 28 and by pushing screw 30 axially through the opening 26 such that the head of the screw 30 abuts the right-hand exterior side surface of lever 16, such that the left-hand distal end of key 28 is flush with or extends from the left-hand exterior side surface of the lever, it may be readily visually determined that the angular cam surface 28*b* is free of the hole 22 and that the lever assembly may be readily positioned over the shaft 14 without interference.

The foregoing has described a particular assembly for attachment of an actuator lever to a limit switch rotatable operating shaft wherein a sliding key having an angular cam surface for wedging against the operating shaft is non-rotatably, linearly slidable within a cavity. It is to be understood that the invention is susceptible of various modifications, such as providing a threaded opening entirely within the key for receiving the threaded shank of the screw or by providing a non-rectangular, but otherwise non-rotatably keyed assembly to prevent rotation of the wedge element within a complementally shaped cavity, without departing from the scope of the appended claims.

We claim:

1. An electrical limit switch having a rotatable shaft and an actuator lever attached to said shaft, said actuator lever comprising:

a hole extending through said actuator lever adapted to receive said shaft therein;

a straight-sided cavity extending into said lever from one exterior side surface of said lever, said cavity partially intersecting said hole;

an opening in another exterior side surface of said lever, said opening extending into said cavity;

a screw projecting through said opening having a threaded shank disposed in said cavity;

a key slidably disposed for reciprocal movement in said cavity, said key having a threaded portion engaged with said threaded shank and a straight-sided cross-sectional shape complemental to said straight-sided cavity preventing rotation of said key within said cavity, said key comprising a cam drawn against said shaft by rotation of said screw to clamp said lever to said shaft.

2. The electrical limit switch actuator lever of claim 1 wherein said cam is withdrawn from said hole when an end of said key is flush with said one exterior side surface of said lever.

3. The electrical limit switch actuator lever of claim 2 wherein said screw is axially slidable in said opening.

4. The electrical limit switch actuator lever of claim 3 wherein sliding movement of said screw effects sliding movement of said key.

5. The electrical limit switch actuator lever of claim 4 wherein said cam is an angled surface on one side of said key, said cam projecting into said hole at said intersection of said cavity with said hole.

6. The electrical limit switch actuator lever of claim 5 wherein said threaded portion of said key comprises a semi-cylindrical groove along a side of said key opposite side one side thereof, and said screw shank is disposed in said groove and abuts a corresponding surface of said cavity.

7. The electrical limit switch actuator lever of claim 6 wherein said corresponding surface of said cavity comprises a semi-cylindrical groove for receiving said threaded shank.

8. An actuator lever for an electrical limit switch, said lever being adapted for attachment to a rotatable operating shaft of said limit switch, said lever comprising:

a round hole extending through said lever along a first axis, said hole being adapted to receive said operating shaft;

a rectangular cavity extending into said lever from a side exterior surface of said lever along a second axis oriented transversely to said first axis, said rectangular cavity partially intersecting said hole;

an opening extending into said lever from an opposite side exterior surface along said second axis, said opening communicating with said rectangular cavity;

a rectangular key member slidably disposed in said cavity, said key member having an angular cam surface positioned adjacent said intersection of said rectangular cavity and said hole, and helically threaded means along said second axis; and a screw inserted through said opening having a head portion abutting said opposite side exterior surface and a threaded shank engaging said helically threaded means, rotation of said screw effecting non-rotatable linear sliding movement of said key member within said cavity to move said cam surface into and out of said hole.

9. The actuator lever for an electrical limit switch of claim 8 wherein said angular cam surface is positioned out of said hole when an end of said key is flush with said side exterior surface of said lever.

10. The actuator lever for an electrical limit switch of claim 9 wherein said screw is axially slidable through said opening.

11. The actuator lever for an electrical limit switch of claim 10 wherein said helically threaded means comprises a semi-cylindrical groove in a surface of said key member opposite said angular cam surface, said groove having partial threads therein.

12. The actuator lever for an electrical limit switch of claim 11 wherein a side of said cavity complemental to said surface of said key member comprises a semi-cylindrical groove complemental to said groove in said key member and cooperating therewith to surround said threaded shank of said screw.

13. A method of attaching an actuator lever to a rotatable shaft of an electrical limit switch comprising:

providing a first hole through said lever;

providing a rectangular cavity in said lever open to one exterior side of said lever and partially intersecting said hole;

providing an opening through an exterior side of said lever opposite said one exterior side thereof and extending into said cavity;

providing a key having a rectangular cross-section complemental to a cross-sectional shape of said cavity, and further having a cam extending therefrom aligned with said intersection of said cavity with said hole, with machine screw threads;

inserting said key into said cavity;

inserting a screw through said opening and threadably engaging said key with said screw;

sliding said screw into said cavity until a head of said screw is stopped against an exterior surface of said lever;

rotating said screw to slide said key within said cavity until an end of said key is flush with said one exterior side of said lever whereupon said cam is withdrawn from projecting into said hole;

positioning said lever over said shaft wherein said shaft extends within said hole; and rotating said screw to slide said key into said cavity and draw said cam surface tight against said shaft within said intersection.

* * * * *